343-909 SR
3/31/81 OR 4,259,674

United States Patent [19]
Dragone et al.

[11] 4,259,674
[45] Mar. 31, 1981

[54] PHASED ARRAY ANTENNA ARRANGEMENT WITH FILTERING TO REDUCE GRATING LOBES

[75] Inventors: Corrado Dragone, Little Silver; Michael J. Gans, Monmouth Beach Township, Monmouth County, both of N.J.

[73] Assignee: Bell Laboratories, Murray Hill, N.J.

[21] Appl. No.: 87,746

[22] Filed: Oct. 24, 1979

[51] Int. Cl.[3] ..... H01Q 15/02
[52] U.S. Cl. ..... 343/909; 343/753
[58] Field of Search ..... 343/100 LE, 753, 754, 343/755, 872, 909, 911 R

[56] References Cited

U.S. PATENT DOCUMENTS

| | | | |
|---|---|---|---|
| 3,797,020 | 3/1974 | Roger et al. | 343/756 |
| 3,877,031 | 4/1975 | Mailloux et al. | 343/778 |
| 4,021,812 | 5/1977 | Schell et al. | 343/753 |
| 4,169,268 | 9/1979 | Schell et al. | 343/909 |

OTHER PUBLICATIONS

Mueller, M. R. et al., "Apodization Filtering Applied to a Bandlimited Optical Fourier Transform", *Applied Optics*, vol. 15, No. 3, 3/76, pp. 690–695.

Agrawal, V., "Grating Lobe Suppression in Phased Arrays by Subarray Rotation", Proceedings of the IEEE, vol. 66, No. 3, 3/78, p. 347.

*Primary Examiner*—David K. Moore
*Attorney, Agent, or Firm*—Erwin W. Pfeifle

[57] ABSTRACT

The present invention relates to a method for reducing the grating lobes associated with phased array antenna arrangements. The present invention, which may be employed with any phased array antenna arrangement, consists of disposing a filtering means capable of blocking the grating lobes at any real focal point in the focal plane of the antenna arrangement. The size of the central region of the filter is determined by the desired field of view at the far-field, and may be adjusted so as to reduce the grating lobes to an admissible level with minimal gain degradation of the main beam.

5 Claims, 7 Drawing Figures

FIG. 2
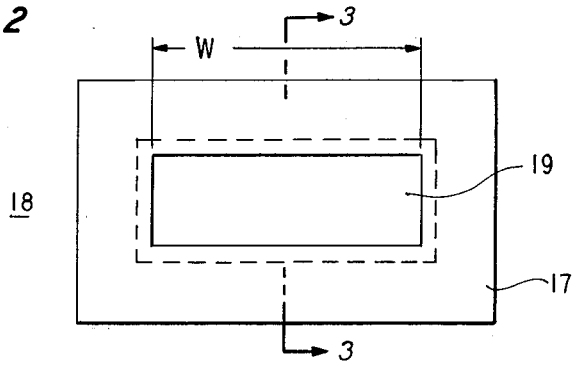
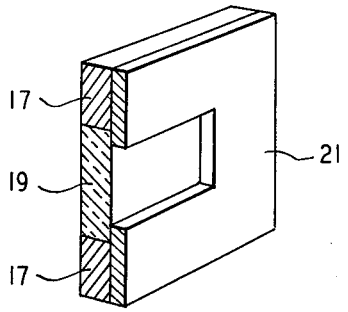
FIG. 3
FIG. 4
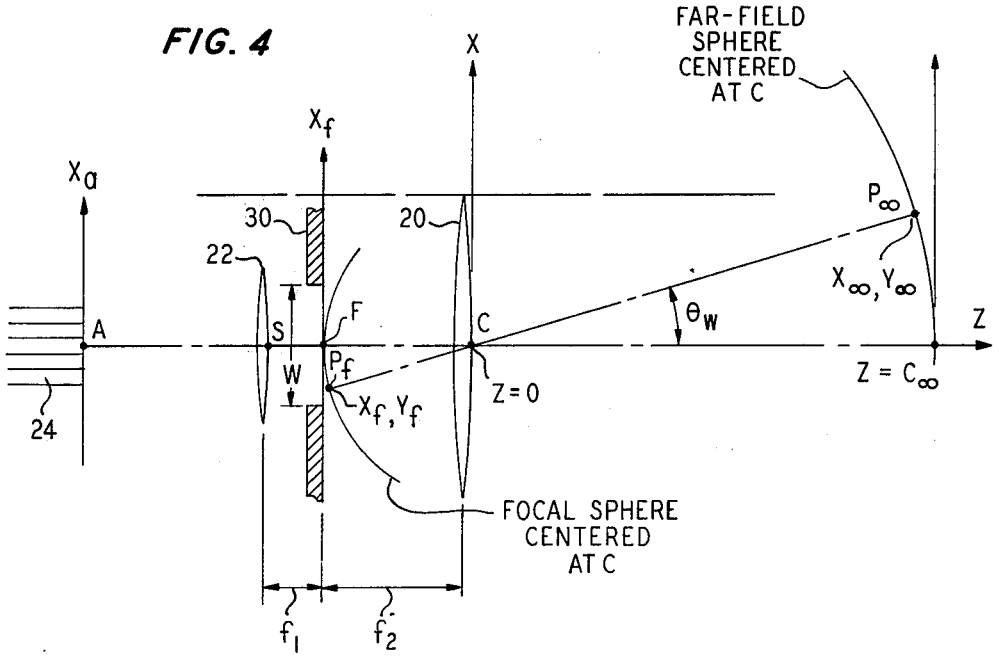

PHASED ARRAY ANTENNA ARRANGEMENT WITH FILTERING TO REDUCE GRATING LOBES

BACKGROUND OF THE INVENTION

1. Technical Field

This invention relates to a phased array antenna arrangement with filtering to reduce grating lobes, and more particularly, to placing a filter at one of the antenna arrangment's real focal points in such a manner so as to block the grating lobes due to the array structure while allowing the central ray to pass through the filter.

2. Description of the Prior Art

Scanned reflector or lens antennas are most often proposed or used for grating lobe reduction because of their high gain, their simplicity, and their minimization of the array problem. One such type of scanned reflector antenna is disclosed in U.S. Pat. No. 3,877,031 issued to R. Mailloux et al on Apr. 8, 1975, which relates to method and apparatus for suppressing grating lobes in an electronically scanned antenna array. Grating lobe suppression is realized by adding odd mode power to the fundamental even mode power that normally drives each radiating element of the array. The odd mode power is maintained ±90 degrees out of phase with the even mode power at each radiating element aperture. The ratio of even mode power to odd mode power is varied as a function of main beam displacement from broadside to control the amount of grating lobe radiation. However, the scanning capability of the Mailloux et al arrangement decreases as the main reflector gain is increased. Moreover, the Mailloux et al arrangement has a low aperture efficiency and so must be large as compared with an efficiently illuminated aperture.

Another method of grating lobe reduction is disclosed in U.S. Pat. No. 4,021,812 issued to A. Schell et al on May 3, 1977, which relates to suppression of side lobes and grating lobes in directional beam forming antennas by the use of a spatial filter. The filter consists of flat layers of high dielectric-constant material separated by air or other low dielectric-constant materials. The filter is placed directly over the feed array, the dielectric-constant and thickness values thereby effecting full transmission of beam power in a selected beam direction so as to suppress side and grating lobes.

Grating lobe reduction may also be obtained by strategically arranging the array elements. An example of this is contained in the article entitled "Grating-Lobe Suppression in Phased Arrays by Subarray Rotation" by V. Agrawal in *Proceedings of the IEEE*, Vol. 66, No. 3, March 1978 at pp. 347–349. In this method, the array is divided into equal subarrays which are physically rotated with respect to each other by specified angles. As a result, the grating lobes, which remain at the same angular distance from the main beam, are multiplied in number by the number of subarrays while their amplitude is divided by the same number. Therefore, in a combined pattern, the main beams of the subarrays will add, while the grating lobes of each subarray will be positioned over a null of another of the remaining subarrays.

The problem remaining in the prior art is to achieve grating lobe suppression in phased array systems by utilizing a simplified array arrangement without excessive degradation in performance of the system.

SUMMARY OF THE INVENTION

The problem remaining in the prior art has been solved in accordance with the present invention, which relates to a phased array antenna arrangement with filtering to reduce grating lobes, and more particularly, to placing a filter at one of the antenna arrangment's real focal points in such a manner so as to block the grating lobes due to the array structure while allowing the central ray to pass through the filter.

It is an aspect of the present invention to provide filtering by means of a stop with a predetermined aperture, an apodizing screen and a phase plate, a stop having a center region containing a dielectric material of varying thickness, or any such suitable device, positioned in the focal plane at one of the real focal points of the antenna arrangement. The field distribution over the main reflector aperture is then a smoothed version of the array distribution and, as a consequence, grating lobes in the far-field are virtually absent.

Other and further aspects of the present invention will become apparent during the course of the following description and by reference to the accompanying drawings.

BRIEF DESCRIPTION OF THE DRAWINGS

Referring now to the drawings, in which like numerals represent like parts in several views:

FIG. 2 is a front view of an exemplary filter in accordance with the present invention;

FIG. 3 is a side cross-sectional view of a variant of the filter shown in FIG. 2;

FIG. 4 illustrates a side cross-sectional view of the geometric optic equivalent of the antenna arrangement of FIG. 1;

DETAILED DESCRIPTION

A Gregorian phased array antenna arrangement is used in the description that follows and the accompanying drawings for illustrative purposes only. It will be understood that such description is exemplary only and is for purposes of exposition and not for purposes of limitation since the present invention is applicable to any type of phased array antenna arrangement.

Figure 1:
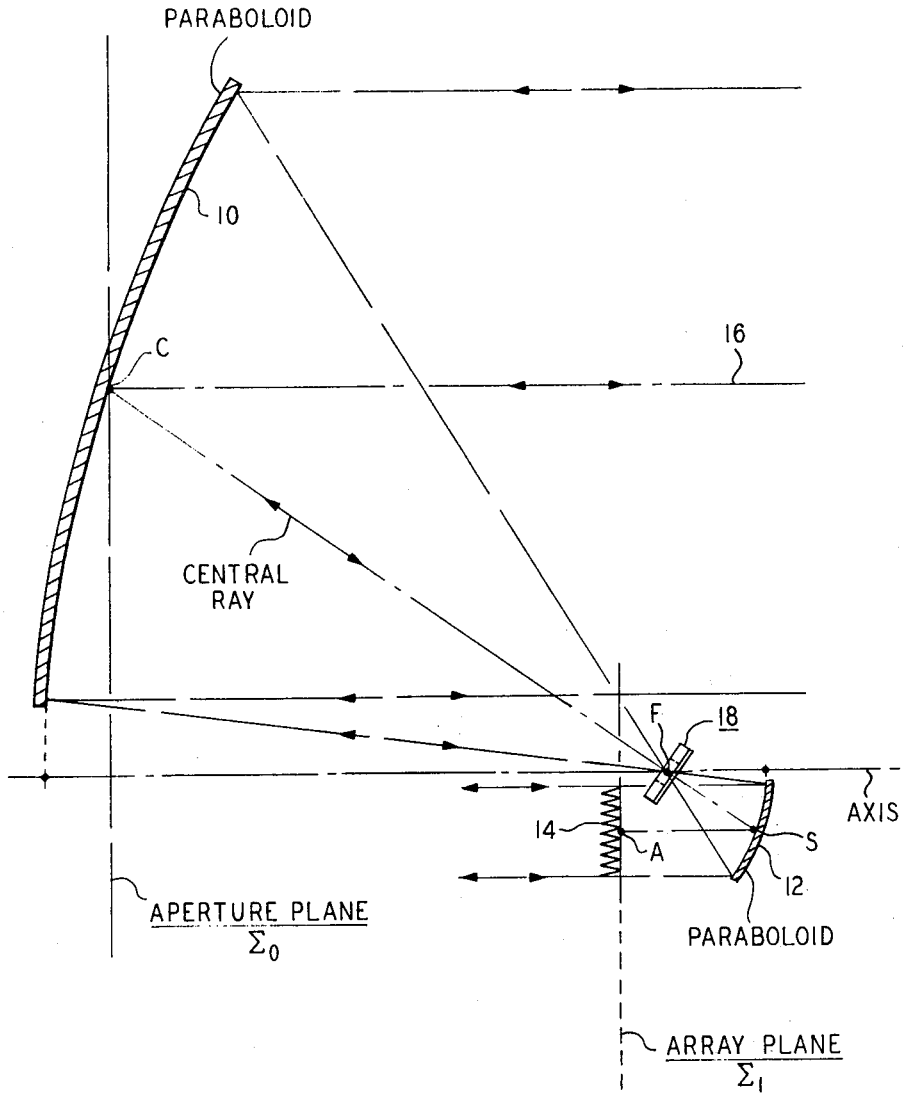
FIG. 1 is a partial side cross-sectional view of an examplary Gregorian phased array antenna arrangement in accordance with the present invention.

In FIG. 1, an exemplary Gregorian phased array antenna arrangement in accordance with the present invention is shown. A main parabolic reflector 10 and a parabolic subreflector 12 are arranged confocally and coaxially so that a magnified image of a small feed array 14 disposed along an array plane $\Sigma_1$ is formed over the aperture of main reflector 10 along an aperture plane $\Sigma_0$. Due to the confocal and coaxial arrangement described hereinabove, both focal point F and the axis of main reflector 10 and subreflector 12 correspond.

A central ray 16 of a planar wavefront arriving from a remote location at main reflector 10 illuminates main reflector 10 along the aperture plane $\Sigma_0$. Let C be the central point of main reflector 10 and S be the central point of subreflector 12, where S is the point at which central ray 16 impinges subreflector 12 after being reflected at point C of main reflector 10. The central point, A, of feed array 14 is then defined as the point at which central ray 16 impinges feed array 14 after being reflected at point S of subreflector 12. In accordance with the present invention, a filter 18 comprising a central region corresponding to the shape of the field of view to be scanned and capable of passing electromagnetic waves, is positioned at focal point F, which is the only real focal point of the arrangement.

A front view of an exemplary filter 18 is shown in FIG. 2, where filter 18 comprises a rectangular metal sheet 17 including a central region 19 of width W. Central region 19 may be merely an aperture of width W, or a dielectric substance of uniform or varying thickness, the variability functioning so as to contour the resulting radiation pattern to achieve the desired result. The width W of this central region is related to the desired width of the far-field image of feed array 14 of FIG. 1, this relation being described in greater detail hereinbelow in association with FIG. 4.

A variant of this filter arrangement is shown in FIG. 3, where absorbing material 21 is disposed as a coating on filter 18. Absorbing material 21 functions so as to absorb the radiation impinging the surface thereof, rather than allowing the radiation to merely be reflected as would occur with the configuration of FIG. 2. As shown in FIG. 3, absorbing material 21 may extend into the central region 19 of filter 18 so as to assist in achieving the desired radiation pattern by absorbing certain sidelobe radiation. It is be be understood that the shape and composition of the above-described filter and the filter of FIG. 2 are illustrative only, pertaining to the specific embodiment of the present invention as shown in FIG. 1, and are not for purposes of limitation since any suitable shape and composition of filter may be employed and still fall within the spirit and scope of the present invention.

In order to simplify the mathematics involved with the present invention, a geometric optic equivalent lens diagram representative of the arrangement of FIG. 1 is shown in FIG. 4.

To determine propagation in the vicinity of central ray 16, Fresnel's diffraction formula is used in conjunction with lenses 20 and 22 of FIG. 4, where lens 20 corresponds in size and function to main reflector 10 of FIG. 1 and lens 22 corresponds in size and function to subreflector 12 of FIG. 1, lens 20 having focal length $f_2$ and lens 22 having focal length $f_1$. Feed array 24 is disposed in the X, Y-plane and corresponds to feed array 14 of FIG. 1. Points A, S, F and C of FIG. 4 correspond to the central points previously described hereinabove in association with FIG. 1. The Z-axis shown in FIG. 4 corresponds to the path of central ray 16 as shown in FIG. 1. A stop 30, with aperture W, is inserted at a real focal point of the arrangement, in this case the X, Y-plane, at focal point F, and corresponds to filter 18 of FIG. 1.

A point designated $C_\infty$ is disposed along the Z-axis at a distance from lens 20 so as to correspond to the far-field image of feed array 24. A sphere centered at central point C and passing through point $C_{28}$ is denoted the far-field sphere, where $X_\infty$, $Y_\infty$ are the X, Y-coordinates of a point $P_{28}$ on this sphere. A corresponding focal sphere is obtained by drawing a sphere centered at C and passing through focal point F. The coordinates $X_f$, $Y_f$ of point $P_f$ corresponding to point $P_{28}$ on the far-field sphere are obtained from $$X_f = \frac{-X_\infty}{C_\infty} f_2, \quad Y_f = \frac{-Y_\infty}{C_\infty} f_2. \tag{1}$$

Point $P_{28}$ is chosen so as to correspond with the desired width of the far-field image of feed array 24. The angle $\theta_W$ then corresponds to the sector of the far-field sphere between points $C_{28}$ and $P_{28}$, or, likewise, the sector of the focal sphere between points F and $P_f$.

This value of $\theta_W$ can then be used to determine the aperture size, W, of stop 30 and subsequently, filter 18 of FIG. 1. By employing simple geometry techniques, the aperture size W can be determined by $$W = 2f_2 \tan\theta_W. \tag{2}$$

Figure 5:
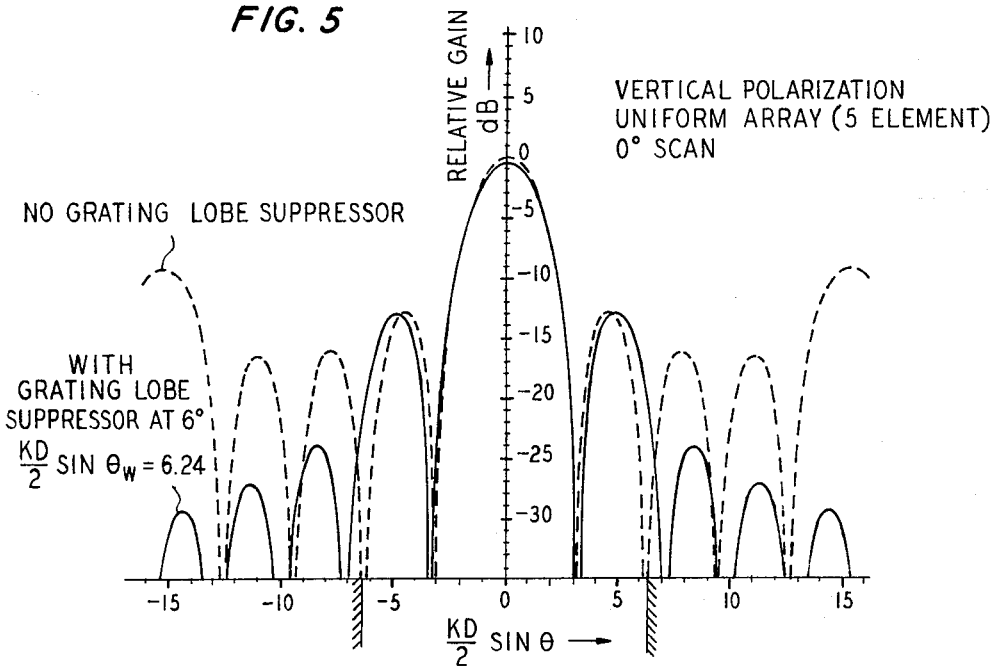
FIG. 5 illustrates the Y-plane radiation pattern for the phased array antenna arrangement of FIG. 1, where the dashed curve represents the radiation pattern for the arrangement without filtering, and the solid curve represents the radiation pattern for the arrangement with filtering as shown in FIG. 1.
Figure 6:
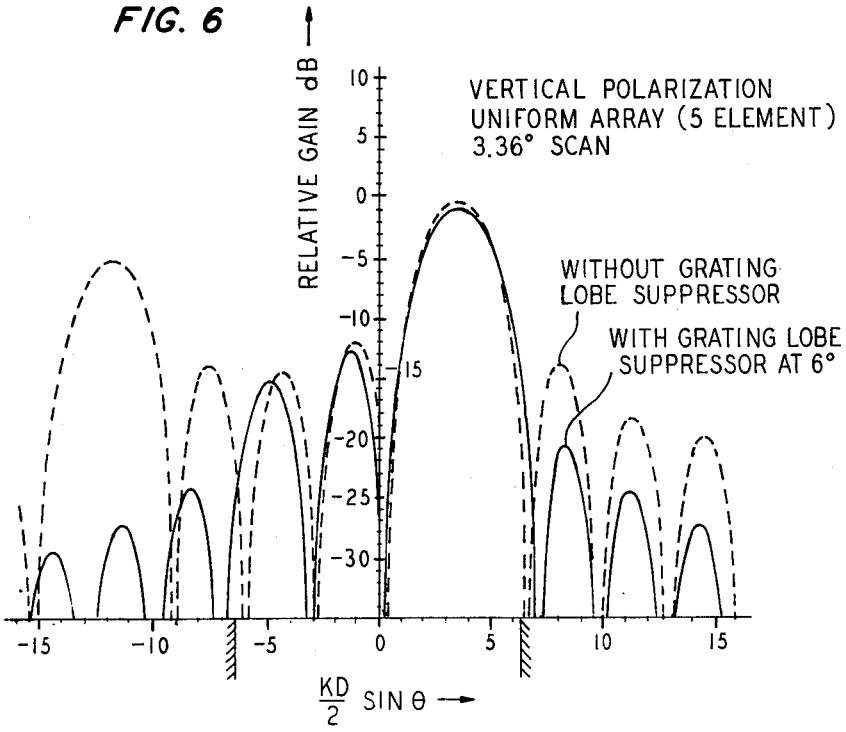
FIG. 6 illustrates the Y-plane radiation pattern for an off-axis phased array antenna arrangement, where the dashed curve represents the radiation pattern for the arrangement without filtering, and the solid curve represents the radiation pattern with filtering, in accordance with the present invention.

To illustrate the effect of the present invention, FIG. 5 contains the radiation pattern of the far-field associated with the configuration of FIGS. 1 and 4. Feed array 14 of FIG. 1 associated with the radiation pattern of FIG. 5 comprises five elements polarized in the Y-direction, where in this specific example the array is designed to receive signals at 11.8 GHz. It is assumed that the elements of feed array 14 are in phase, and therefore the main beam is centered at $\theta=0$ degrees. The value of $\theta_W$ is chosen to be 6 degrees, where this value allows for substantial reduction of the grating lobes without excessive gain degradation in the main beam. Sidelobes appear at $\pm 5$, $\pm 8$ and $\pm 11$ degrees and the first grating lobes appear at approximately $\pm 15$ degrees from the main beam, as shown by the dashed curve of FIG. 5, and are reduced significantly by employing the filtering means of the pesent invention, as shown by the solid curve of FIG. 5. Note that the reduction in gain of the main beam is neglibible for this value of $\theta_W$. The curves shown in this and the subsequent figure, however, are not limited to the specific value of 11.8 GHz, rather the curves are equally applicable to any five-element Gregorian antenna arrangement in compliance with equations (1) and (2) and in accordance with the present invention. The present invention may also be employed in instances where the main beam is not centered at $\theta=0$ degrees. In FIG. 6, the main beam is displaced from the axis $\theta=0$ degrees by an angle of scan $\theta_s$, in this case $\theta_s=3.36$ degrees. Note that the grating lobe appearing in the pattern without filtering is reduced by employing the filtering means of the present invention with $\theta_W=6$ degrees.

An application of current interest is a synchronous satellite antenna with a movable beam required to illuminate at, for example, 11.8 GHz a narrow strip of the United States. The illuminated area covers the entire width of the United States, from north to south. From east to west, only one-tenth of the United States is illuminated and a linear array must be used to direct the beam to any desired location. Since the beamwidth is about one-tenth of the field of view, the number N of array elements must be at least ten.

Figure 7:
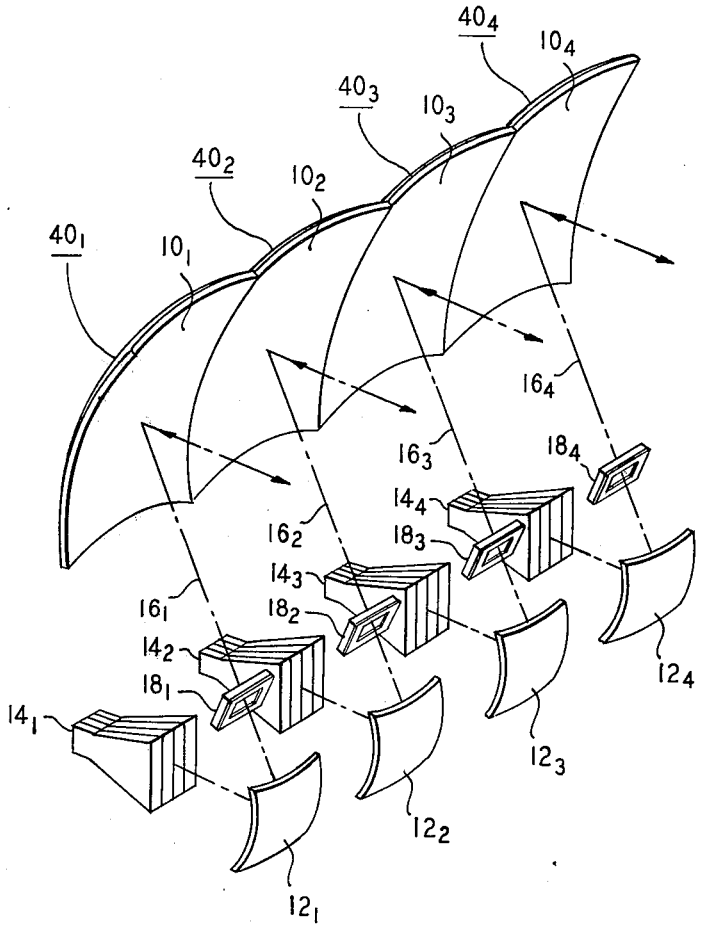
FIG. 7 illustrates an exemplary antenna arrangement in perspective capable of illuminating a narrow strip of the United States, the arrangement comprising four adjacent identical Gregorian arrangements of four-element arrays, in accordance with the present invention.

An exemplary antenna system design in accordance with the present invention and capable of being employed in the specific example described hereinabove is shown in FIG. 7. In this case, the antenna system comprises four adjacent identical arrays, each array disposed in a Gregorian antenna configuration in accordance with FIG. 1. A multiple array configuration is employed in order to achieve an equivalent main reflector of larger dimension than physically possible by employing a single array. The antenna system thus comprises four distinct main reflectors, $10_1$, $10_2$, $10_3$ and $10_4$, four distinct subreflectors $12_1$, $12_2$, $12_3$ and $12_4$, four distinct feed arrays $14_1$, $14_2$, $14_3$ and $14_4$, four distinct central rays $16_1$, $16_2$, $16_3$ and $16_4$, and four distinct filters $18_1$, $18_2$, $18_3$ and $18_4$, where elements $10_1$, $12_1$, $14_1$, $16_1$ and $18_1$ are combined in accordance with FIG. 1 to form array $40_1$, and continuing in a like manner, elements $10_4$, $12_4$, $14_4$, $16_4$ and $18_4$ are combined in accordance with FIG. 1 to form array $40_4$. The antenna receives, for example, horizontal polarization at 14.25 GHz, and transmits, for example, vertical polarization at 11.8 GHz. Strong grating lobes arising without filtering are substantially reduced by employing the present invention, with only a small reduction, less than 0.4 dB, in beam gain.

It is to be understood that the above-described embodiments are simply illustrative of the principles of the invention. Various other modifications and changes may be made by those skilled in the art which will embody the principles of the invention and fall within the spirit and scope thereof.

We claim:

1. A phased array antenna arrangement comprising
a plurality of reflectors (10,12) arranged in sequence along a feed axis of the system, each reflector comprising a curved focusing reflecting surface and a focal point, where each focal point can be either one of a real and an imaginary form;
and a feedhorn array (14) disposed on an image plane of the aperture plane of said antenna arrangement capable of launching a beam comprising a central ray (16) and a plurality of grating lobes
CHARACTERIZED IN THAT
the antenna system further comprises
a filtering means (18) disposed at one of the focal points of the plurality of reflectors, said focal point being a real focal point disposed between a pair of subsequent reflectors, said filtering means being capable of passing the central ray and blocking the plurality of grating lobes associated with the beam being launched from the feedhorn.

2. A phased array antenna system in accordance with claim 1
CHARACTERIZED IN THAT
the filtering means (18) comprises a metallic sheet (17) including a central aperture of width W, width W being of such dimension as to allow the filtering means to be capable of blocking the grating lobes impinging the surface thereof.

3. A phased array antenna system in accordance with claim 2
CHARACTERIZED IN THAT
the filtering means (18) comprises a metallic sheet (17) including a central region (19) of alternative material and width W, width W being of such dimension as to allow said filtering means to be capable of blocking the grating lobes impinging the surface thereof.

4. A phased array antenna system in accordance with claim 3
CHARACTERIZED IN THAT
central region (19) comprises a dielectric material of varying thickness and width W, the varying thickness and width W being of such proportions as to allow the filtering means to be capable of blocking the grating lobes impinging the surface thereof.

5. A phased array antenna system in accordance with claims 1, 2, 3 or 4
CHARACTERIZED IN THAT
the metallic sheet further comprises a coating (21) of absorbing material disposed on the surface of said metallic sheet capable of absorbing the grating lobes impinging the surface thereof.

* * * * *

UNITED STATES PATENT AND TRADEMARK OFFICE

CERTIFICATE OF CORRECTION

PATENT NO. : 4,259,674

DATED : March 31, 1981

INVENTOR(S) : Corrado Dragone and Michael J. Gans

It is certified that error appears in the above-identified patent and that said Letters Patent are hereby corrected as shown below:

Column 4, line 6, "$C_{28}$" should read --$C_{\infty}$--; line 8, "$P_{28}$" should read --$P_{\infty}$--; line 11, "$P_{28}$" should read --$P_{\infty}$--; line 16, "$P_{28}$" should read --$P_{\infty}$--; line 21, "$C_{28}$ and $P_{28}$" should read --$C_{\infty}$ and $P_{\infty}$--; line 46, "pesent" should read --present--.

Signed and Sealed this

*Twenty-seventh* Day of *October 1981*

[SEAL]

*Attest:*

GERALD J. MOSSINGHOFF

*Attesting Officer*

*Commissioner of Patents and Trademarks*